US005252895A

United States Patent [19]

Leksell et al.

[11] Patent Number: 5,252,895

[45] Date of Patent: Oct. 12, 1993

[54] TFEL EDGE EMITTER STRUCTURE WITH LIGHT EMITTING FACE AT ANGLE GREATER THAN NINETY DEGREES TO SUBSTRATE STREET

[75] Inventors: David Leksell, Oakmont; Norman J. Phillips; Zoltan K. Kun, both of Pittsburgh, all of Pa.

[73] Assignee: Westinghouse Electric Corp., Pittsburgh, Pa.

[21] Appl. No.: 697,371

[22] Filed: May 9, 1991

[51] Int. Cl.[5] ..... G09G 3/30

[52] U.S. Cl. ..... 313/506; 313/509

[58] Field of Search ..... 313/506, 509, 498; 315/169.3; 340/781; 346/155, 160

[56] References Cited

U.S. PATENT DOCUMENTS

| | | | |
|---|---|---|---|
| 4,006,383 | 2/1977 | Luo et al. | 315/169 TV |
| 4,110,664 | 8/1978 | Asars et al. | 315/169 TV |
| 4,464,602 | 8/1984 | Murphy | 313/509 |
| 4,535,341 | 8/1985 | Kun et al. | 346/107 R |
| 4,734,723 | 3/1988 | Ishitobi | 346/160 |
| 4,807,047 | 2/1989 | Sato et al. | 358/300 |
| 4,849,674 | 7/1989 | Cherry et al. | 313/509 |
| 4,951,064 | 8/1990 | Kun et al. . | |
| 5,043,632 | 8/1991 | Asars et al. | 340/781 |
| 5,043,715 | 8/1991 | Kun et al. | 340/781 |
| 5,055,363 | 10/1991 | Tomomura et al. | 313/506 |

FOREIGN PATENT DOCUMENTS

| | | |
|---|---|---|
| 2812592 | of 0000 | Fed. Rep. of Germany . |
| 63-91998 | 4/1988 | Japan . |

*Primary Examiner*—Donald J. Yusko
*Assistant Examiner*—John E. Giust
*Attorney, Agent, or Firm*—E. R. Jarosik

[57] ABSTRACT

A TFEL edge emitter structure has a bottom substrate layer, a lower common electrode layer applied over the bottom substrate layer an upper control electrode layer, and a middle EL light-energy generating stack disposed between the lower common electrode and the upper control electrode layers. The middle EL stack includes a lower dielectric layer, an upper dielectric layer, and a middle light-energy generating layer. The lower dielectric layer overlies the lower common electrode layer and bottom substrate layer. The middle light-energy generating layer is deposited over the lower dielectric layer. The upper dielectric layer is deposited over the middle light-energy generating layer. A light emitting face on a front edge of the EL stack is disposed at an angle relative to a street on the front edge portion of the substrate layer that is greater than ninety degrees. The angle selected should be sufficiently greater than ninety degrees relative to the substrate layer street so that a divergent zone of light emitted by the face is not obstructed by the street. A focussing lens is located at a position spaced in front of the inclined light emitting face of the TFEL edge emitter structure where the lens will intercept and intensify a zone of light emerging from the inclined face. A central axis of the focussing lens extends perpendicular to the respective light emitting face.

7 Claims, 2 Drawing Sheets

TFEL EDGE EMITTER STRUCTURE WITH LIGHT EMITTING FACE AT ANGLE GREATER THAN NINETY DEGREES TO SUBSTRATE STREET

CROSS REFERENCE TO RELATED APPLICATIONS

Reference is hereby made to the following copending U.S. applications dealing with related subject matter and assigned to the assignee of the present invention:

1. "A Thin Film Electroluminescent Edge Emitter Structure On A Silicon Substrate" by Z. K. Kun et al, assigned U.S. Ser. No. 273,296 and filed Nov. 18, 1988, a continuation-in-part of U.S. Ser. No. 235,143, filed Aug. 23, 1988. U.S. Pat. No. 5,004,956 issued Apr. 2, 1991.

2. "Process For Defining An Array Of Pixels In A Thin Film Electroluminescent Edge Emitter Structure" by W. Kasner et al, assigned U.S. Ser. No. 254,282 and filed Oct. 6, 1988. U.S. Pat. No. 4,895,448 issued on Dec. 5, 1989.

3. "A Multiplexed Thin Film Electroluminescent Edge Emitter Structure And Electronic Drive System Therefor " by D. Leksell et al, assigned U.S. Ser. No. 343,697 and filed Apr. 24, 1989. U.S. Pat. No. 4,899,184 issued Feb. 6, 1990 and U.S. Pat. No. 4,947,160 issued Aug. 7, 1990.

4. "A Thin Film Electroluminescent Edge Emitter Assembly And Integral Packaging" by Z. K. Kun et al, assigned U.S. Ser. No. 351,495 and filed May 15, 1989. U.S. Pat. No. 4,951,064 issued Aug. 21, 1990.

5. "Thin Film Electroluminescent Edge Emitter Structure With Optical Lens And Multi-Color Light Emission Systems" by Z. K. Kun et al, assigned U.S. Ser. No. 353,316 and filed May 17, 1989, a continuation-in-part of U.S. Ser. No. 280,909, filed Dec. 7, 1988, which is a continuation-in-part of U.S. Ser. No. 248,868, filed Sep. 23, 1988. U.S. Pat. No. 5,043,715 issued Aug. 27, 1991 and U.S. Pat. No. 5,138,347 issued Aug. 11, 1992.

6. "Integrated TFEL Flat Panel Face And Edge Emitter Structure Producing Multiple Light Sources" by Z. K. Kun et al, assigned U.S. Ser. No. 377,690 and filed Jul. 10, 1989. U.S. Pat. No. 5,101,137 issued Mar. 31, 1992.

7. "Multi-Layer Structure And Method Of Constructing The Same For Providing TFEL Edge Emitter Modules" by D. Leksell et al, assigned U.S. Ser. No. 434,397 and filed Nov. 13, 1989. U.S. Pat. No. 5,118,987 issued Jun. 6, 1992.

8. "TFEL Edge Emitter Module And Packaging Assembly Employing Sealed Cavity Capacity Varying Mechanism" by Norman J. Phillips et al, assigned U.S. Ser. No. 07/434,392 and filed Nov. 13, 1989. U.S. Pat. No. 5,017,824 issued May 21, 1991.

BACKGROUND OF THE INVENTION

1. Field of the Invention

The present invention relates generally to an electronically controlled, high resolution light source, and more particularly, to a thin film electroluminescent (TFEL) edge emitter structure having a light emitting face at an angle greater than ninety degrees relative to a street defined along the forward edge of the substrate of the TFEL edge emitter structure.

2. Description of the Prior Art

Electroluminescence is a phenomena which occurs in certain materials from the passage of an electric current through the material. The electric current excites the electrons of the dopant in the light emitting material to higher energy levels. Emission of radiation thereafter occurs as the electrons emit or give up the excitation energy and fall back to lower energy levels. Such electrons can only have certain discrete energies. Therefore, the excitation energy is emitted or radiated at specific wavelengths depending on the particular material. TFEL devices that employ the electroluminescence phenomena have been devised in the prior art. It is well known to utilize a TFEL device to provide an electronically controlled, high resolution light source. One arrangement which utilizes the TFEL device to provide the light source is a flat panel display system such as disclosed in U.S. Pat. Nos. to Asars et al (4,110,664) and Luo et al (4,006,383), assigned to the assignee of the present invention. In a TFEL flat panel display system, light emissions are produced substantially normal to a face of the device and so provide the light source at the device face. Another arrangement utilizing the TFEL device to provide the light source is a line array, or edge, emitter, such as disclosed in a U.S. Pat. No. to Kun et al (4,535,341), also assigned to the assignee of the present invention. In a TFEL edge emitter system, light emissions are produced substantially normal to an edge of the TFEL device and so provide the light source at the device edge. Edge emissions by the TFEL edge emitter system are typically 30 to 40 times brighter than the face emissions by the TFEL flat panel display system under approximately the same excitation conditions.

From the above discussion, it can be appreciated that the TFEL edge emitter system of the Kun et al patent potentially provides a high resolution light source promising orders of magnitude of improved performance over the TFEL flat panel face emitter system in terms of light emission brightness. For the TFEL edge emitter device to be able to reach its full commercial potential, it must be capable of maximizing the amount of light coming from the light emitting surface. Since the zone of light emerging from the TFEL structure through its light emitting surface or face has a slightly divergent pattern, a focussing lens is typically disposed forwardly of the light emitting face to intercept and intensify the light coming form the ninety-degree light emitting face.

However, as a result of present techniques used in fabricating TFEL edge emitter devices, a front portion of the substrate of the TFEL structure extends forwardly of the light emitting face of the TFEL structure so as to define a street which is disposed at approximately ninety degrees to the TFEL light emitting face. The presence of the street on the substrate interferes with the lower divergent portion of the zone of light and thereby reduces the total amount of light emerging from the ninety-degree light emitting face of the TFEL light emitting structure.

Consequently, a need exists for a way to compensate for the presence of the substrate street so as to avoid interference by it with the emergent zone of light.

SUMMARY OF THE INVENTION

The present invention relates to a modified TFEL edge emitter structure designed to satisfy the aforementioned needs. The modified TFEL edge emitter structure has a light emitting face at an angle greater than ninety degrees relative to the street defined along the forward edge of the substrate of the TFEL edge emitter structure. By increasing the angle of the light emitting face beyond ninety degrees, the surface area of the light emitting edge face is increased, resulting in a corresponding increase in the amount of light emitted from the TFEL edge emitter structure. Also, since the substrate street does not now interfere with the zone of light emitted from the light emitting edge face, an increased amount of light is intercepted and intensified by the focussing lens.

Accordingly, the present invention is directed to a TFEL edge emitter structure which comprises: (a) a bottom substrate layer; (b) an electroluminescent (EL) light-energy generating stack mounted on the bottom substrate layer and having a front edge; (c) a street defined on a front edge portion of the bottom substrate layer extending forwardly from the front edge of the EL stack; and (d) an inclined light emitting face formed on the front edge of the EL stack adjacent to the substrate layer street and being disposed at an angle relative to the substrate layer street that is greater than ninety degrees.

The angle between the inclined light emitting face and substrate street is selected to be sufficiently enough greater than ninety degrees so that a divergent zone of light emitted by the face is not obstructed by the street.

Further, a focussing lens is located at a position spaced in front of the inclined light emitting face of the TFEL edge emitter structure where it will intercept and intensify a zone of light emerging from the inclined face. A central axis of the focussing lens extends perpendicular to the respective inclined light emitting face.

These and other features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DESCRIPTION OF THE PREFERRED EMBODIMENT

In General

Figure 1:
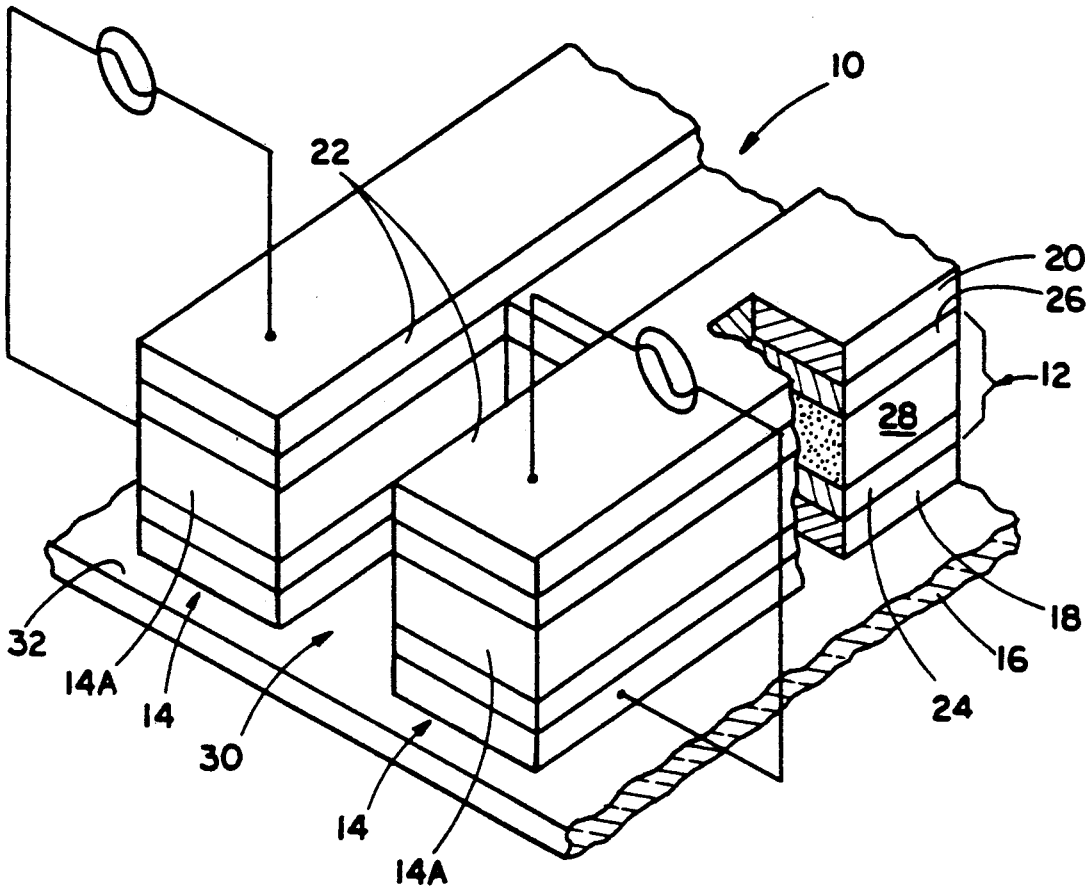
FIG. 1 (PRIOR ART)
FIG. 1 is a fragmentary perspective view of a prior art TFEL edge emitter structure.
Figure 2:
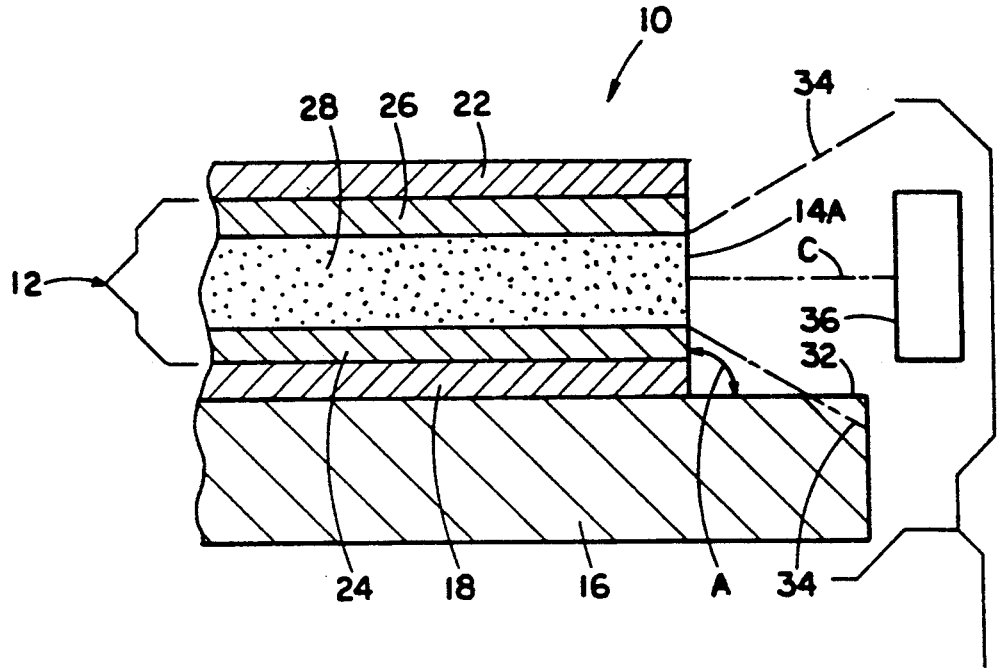
FIG. 2 (PRIOR ART)
FIG. 2 is a fragmentary longitudinal vertical sectional view of a prior art arrangement of the TFEL edge emitter structure with a focussing lens located in front of a light emitting face of the TFEL edge emitter structure which is disposed approximately ninety degrees relative to a street defined along the forward edge of the substrate of the TFEL edge emitter structure.

Referring to the drawings, and particularly to FIGS. 1 and 2, there is illustrated a TFEL edge emitter structure, generally designated 10. The structure 10 is substantially similar in construction to the one disclosed and illustrated in the fourth patent application cross-referenced above, the disclosure of which is incorporated herein by reference. The basic construction of the structure 10 need and will only be described herein to the extent necessary to foster a complete and thorough understanding of the present invention.

As is well-known, the TFEL edge emitter structure 10 employs an electroluminescent (EL) stack 12 having a linear array of spaced-apart pixels 14 with light-emitting front edge faces 14A. The TFEL edge emitter structure 10 provides a solid state, electronically controlled, high resolution light source.

The TFEL edge emitter structure 10 also includes a bottom substrate layer 16, preferably fabricated of a glass material, a lower common electrode layer 18 applied over the bottom substrate layer 16, an upper electrode layer 20 composed of a plurality of upper control electrode elements 22, and the middle EL light-energy generating stack 12 disposed between the lower common electrode 18 and the upper control electrode elements 22.

The middle EL stack 12 includes a lower dielectric layer 24, an upper dielectric layer 26, and a middle light-energy generating layer 28. The lower dielectric layer 24, preferably composed of silicon oxide nitride, overlies the lower common electrode layer 18 and bottom substrate layer 16. Next, the middle light-energy generating layer 28, preferably composed of a phosphor material such as zinc sulfide doped with manganese, is deposited over the lower dielectric layer 24. Then, the upper dielectric layer 26, composed of the same material as the lower dielectric layer 24, is deposited over the middle light-energy generating layer 28.

It should be understood that although the EL stack 12 is illustrated including lower and upper dielectric layers 24, 26, the lower dielectric layer 24 may be eliminated from the EL stack 12 if desired. If the lower dielectric layer 24 is not included in the EL stack 12, then it is apparent that the phosphor layer 28 will be interposed between the lower common electrode layer 18 and the upper dielectric layer 26.

The linear array of pixels 14 of the EL stack 12, which also include the lower common and upper control electrode layers 18, 20, are defined by a series of longitudinal channels 30 and a transverse street 32 connecting the channels 30 on the forward end of the EL stack 12 and electrode layers 18, 20 down to the level of the bottom substrate layer 16. The channels 30 serve to optically isolate adjacent pixels 14 from one another to prevent optical cross-talk. The street 32 is provided as a result of the formation thereabove of the front light-emitting edge faces 14A of the pixels 14.

In the TFEL edge emitter structure 10, light emissions of greatest intensity are produced substantially normal to the edge faces 14A of the EL stack 12. However, as depicted in FIG. 2, the zone of light 34 emerging from the TFEL structure 10 through its light emitting surface or faced 14A has a slightly divergent pattern. A focussing lens 36 can be disposed in front of the edge emitter structure 10 forwardly of the light emitting face 14A to intercept and intensify the divergent zone of light 34 coming from the ninety-degree light emitting face 14A. The presence of the street 32 on the substrate 16, which is disposed at an angle A relative to the light emitting face 14A equal to approximately ninety degrees, interferes with the lower divergent portion of the zone of light 34 and thereby reduces the total amount of light emerging from the ninety-degree light emitting face 14A of the TFEL light emitting structure 10.

Modified TFEL Structure of Present Invention

Figure 3:
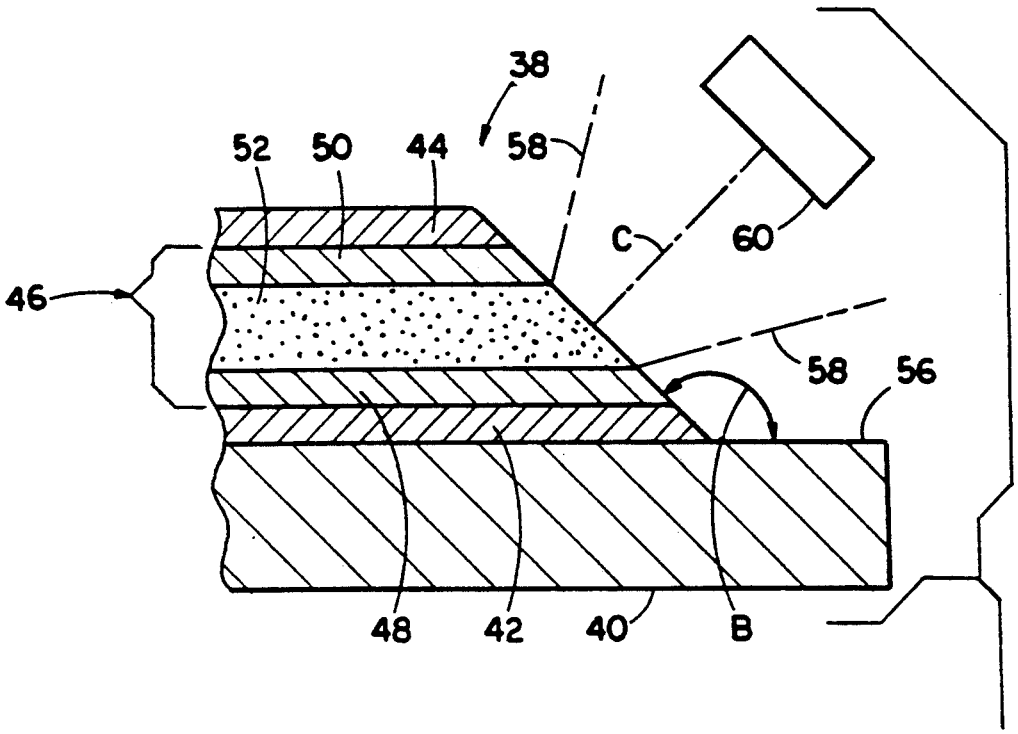
FIG. 3 is a fragmentary longitudinal vertical sectional view of an arrangement of the TFEL edge emitter structure with a focussing lens located in front of a light emitting face of the TFEL edge emitter structure wherein the light emitting face is disposed at an angle greater than ninety degrees relative to the substrate street.

Referring to FIG. 3, there is illustrated a TFEL edge emitter structure 38 composed of the same multiple layers as in the case of the TFEL edge emitter structure 10 of FIGS. 1 and 2. Thus, the edge emitter structure 38 has a bottom substrate layer 40, a lower common electrode layer 42 applied over the bottom substrate layer 40, an upper control electrode layer 44, and a middle EL light-energy generating stack 46 disposed between the lower common electrode 42 and the upper control electrode layers 44.

The middle EL stack 46 includes a lower dielectric layer 48, an upper dielectric layer 50, and a middle light-energy generating layer 52. The lower dielectric layer 48 overlies the lower common electrode layer 42 and bottom substrate layer 40. The middle light-energy generating layer 52 is deposited over the lower dielectric layer 48. The upper dielectric layer 50 is deposited over the middle light-energy generating layer 52. If desired, the lower dielectric layer 48 can be omitted.

The TFEL edge emitter structure 38 of FIG. 3 is modified from the TFEL edge emitter structure 10 of FIGS. 1 and 2 by the provision of the light emitting surface or face 54 on the front edge of the edge emitter structure 38 at an inclination or angle B relative to the substrate layer street 56 that is greater than ninety degrees. The angle B selected should be sufficiently greater than ninety degrees relative to the substrate layer street 56 so that the zone of light 58 emitted by the inclined face 54 is not obstructed by the street 56.

Also, a focussing lens 60 is relocated to a position spaced in front of the inclined light emitting face 54 of the TFEL edge emitter structure 38. As before, the focussing lens 60 will intercept and intensify the zone of light 58 emerging from the face 54. In both the prior art arrangement of FIG. 2 and the modified arrangement of FIG. 3, a central axis C of the lenses 36 and 60 extends perpendicular to the respective light emitting faces 14A and 54.

By increasing the angle B of the light emitting face 54 beyond ninety degrees, the surface area of the light emitting edge face 54 is increased, resulting in a corresponding increase in the amount of light emitted from the TFEL edge emitter structure 38. Also, since the substrate layer street 56 still located adjacent to the inclined light emitting face 54 does not now interfere with the zone of light 58 emitted from the face 54, an increased amount of light is intercepted and intensified by the focussing lens 60.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the forms hereinbefore described being merely preferred or exemplary embodiments thereof.

We claim:

1. A thin film electroluminescent (TFEL) edge emitter structure, comprising:

(a) a bottom substrate layer;

(b) an electroluminescent (EL) light-energy generating stack mounted on said bottom substrate layer and having a front edge;

(c) a street defined on a front edge portion of said bottom substrate layer extending forwardly from said front edge of said EL stack; and (d) an inclined light emitting face which emits a divergent zone of light formed on said front edge of said EL stack adjacent to said substrate layer street and being disposed at an angle relative to said substrate layer street that is sufficiently enough greater than ninety degrees so that divergent zone of light emitted by said face is not obstructed by said street.

2. The structure as recited in claim 1, further comprising:

a lower electrode layer applied over said bottom substrate layer; and an upper electrode layer;

said middle electroluminescent (EL) light-energy generating stack being disposed between said lower and upper electrode layers.

3. The structure as recited in claim 2, wherein said El stack includes:

a lower dielectric layer overlying said lower electrode layer and bottom substrate layer;

an upper dielectric layer; and a middle light-energy generating layer deposited over said lower dielectric layer, said upper dielectric layer being deposited over said middle light-energy generating layer.

4. A thin film electroluminescent (TFEL) edge emitter assembly, comprising:

(a) a TFEL edge emitter structure including (i) a bottom substrate layer, (ii) an electroluminescent (EL) light-energy generating stack mounted on said bottom substrate layer and having a front edge, (iii) a street defined on a front edge portion of said bottom substrate layer extending forwardly from said front edge of said EL stack, and (iv) an inclined light emitting face which emits a divergent zone of light formed on said front edge of said EL stack adjacent said substrate layer street and being disposed at an angle relative to said substrate layer street that is sufficiently enough greater than ninety degrees so that the divergent zone of light emitted by said face is not obstructed by said street; and (b) a focussing lens located at a position spaced in front of said inclined light emitting face of said EL stack such that said lens will intercept and intensify said zone of light emerging from said inclined face.

5. The assembly as recited in claim 4 wherein said lens has a central axis extending perpendicular to said inclined light emitting face.

6. The assembly as recited in claim 4, wherein said TFEL structure further includes:

a lower electrode layer applied over said bottom substrate layer; and an upper electrode layer;

said middle electroluminescent (EL) light-energy generating stack being disposed between said lower and upper electrode layers.

7. The assembly as recited in claim 6 wherein said EL stack includes:

a lower dielectric layer overlying said lower electrode layer and bottom substrate layer;

an upper dielectric layer; and a middle light-energy generating layer deposited over said lower dielectric layer, said upper dielectric layer being deposited over said middle light-energy generating layer.

* * * * *